United States Patent [19]

Isobe et al.

[11] 4,362,535

[45] Dec. 7, 1982

[54] SINTERED METAL BONDED DIAMOND ABRASIVE ARTICLES

[75] Inventors: Eiji Isobe; Izumi Hayakawa; Akira Emura, all of Tokyo, Japan

[73] Assignee: Mitsui Mining & Smelting Co., Ltd., Tokyo, Japan

[21] Appl. No.: 269,013

[22] PCT Filed: Oct. 8, 1980

[86] PCT No.: PCT/JP80/00242

§ 371 Date: Jun. 9, 1981

§ 102(e) Date: May 20, 1981

[87] PCT Pub. No.: WO81/00981

PCT Pub. Date: Apr. 16, 1981

[30] Foreign Application Priority Data

Oct. 9, 1979 [JP] Japan ..... 54-130403

[51] Int. Cl.[3] ..... B24D 3/02

[52] U.S. Cl. ..... 51/309; 51/293

[58] Field of Search ..... 51/293, 309

[56] References Cited

U.S. PATENT DOCUMENTS

| | | | |
|---|---|---|---|
| 3,036,907 | 5/1962 | Bibbins | 51/309 |
| 3,293,012 | 12/1966 | Smiley | 51/309 |
| 3,372,010 | 3/1968 | Parsons | 51/309 |
| 3,389,981 | 6/1968 | Strauss | 51/309 |

FOREIGN PATENT DOCUMENTS

| | | |
|---|---|---|
| 53-83190 | of 1978 | Japan . |
| 55-7517 | 1/1980 | Japan . |

*Primary Examiner*—Donald E. Czaja
*Assistant Examiner*—W. Thompson
*Attorney, Agent, or Firm*—Armstrong, Nikaido, Marmelstein & Kubovcik

[57] ABSTRACT

This invention provides a metal bonded diamond abrasive article of nickel-copper basis. The sintered metal bond, which consists essentially of 2 to 30% by weight of copper, 1 to 40% by weight of tin, 0.2 to 3% by weight of phosphorous, and at least 50% by weight of the remainder nickel, well disperses and retains diamond grits and minimizes the clogging and the variation in rate of stock removal.

2 Claims, No Drawings

SINTERED METAL BONDED DIAMOND ABRASIVE ARTICLES

TECHNICAL FIELD

The present invention relates to a sintered metal bonded diamond composition particularly favorable as abrasives in the form of pellet or wheel for use in fining or polishing lenses or other various materials.

BACKGROUND ART

As sintered metal bonded abrasive articles for the purposes as mentioned above, those of copper-tin basis have so far been used extensively. They exhibit, however, low grinding ratios, in other words, short life, and poor rates of stock removal.

As regards another type of sintered metal bonded abrasive articles, i.e., sintered metal bonded diamond abrasive articles of nickel basis, while a sintering temperature of 1000° C. or more, at which rapid graphitizing of diamond begins to occur, is necessary for preparation thereof because of the high melting point of nickel, lower temperature sintering of nickel has become possible by the use of more finely devided nickel powders, thereby developing a sintered abrasive article having an excellent fining function as well as an improved holding force of diamond grits (Japanese Patent Application Laid-open No. 83190/1978). Furthermore, in order to prevent the clogging of nickel base abrasive articles during long runs of fining, a sintered metal bonded diamond abrasive article exhibiting improved grinding ratios as well as increased rates of stock removal has been developed by the technique wherein an element capable of forming an intermetallic compound with nickel is added to a nickel base to precipitate and disperse a hard and brittle phase of the intermetallic compound in the base (Japanese Patent Application Laid-open No. 7517/1980).

However, the latter sintered metal bonded abrasive article of nickel basis gives stock removal rates fluctuating to a great extent with variations, due to prior roughing process, in surface roughness of works to be ground, and this constitutes a serious obstacle to its practical use in certain applications.

DISCLOSURE OF INVENTION

The object of the invention is to eliminate such disadvantages as mentioned above of sintered metal bonded diamond abrasive articles of nickel basis.

The invention provides an improved sintered metal bonded diamond abrasive article of nickel basis by replacing part of nickel by copper, a relatively inexpensive metal, and adding tin and phosphorous at the same time.

In the abrasive article of the invention, the metal bond holding diamond grits contains 2 to 30% by weight of copper, 1 to 40% by weight of tin, and 0.2 to 3% by weight of phosphorous, with the proviso that the total content of copper, tin, and phosphorous is less than 50% by weight and the remainder is nickel.

The point of the invention is that the choice of suitable compounding proportions of copper, tin, and phosphorous to the base nickel gives excellent grinding characteristics that could not be anticipated from the known behavior of two elements, tin and phosphorous, in the respective nickel-tin and nickel-phosphorous binary systems.

BEST MODE FOR CARRYING OUT THE INVENTION

The base metal nickel in this invention, which as the main constituent of the matrix retains diamond grits, is used, in consideration of diamond-holding force, to be present in an amount of at least 50% by weight in the matrix. The nickel, the main constituent of the matrix, can be replaced by cobalt in certain cases, and thereby nearly the same results are obtained as in the case with nickel.

The copper forms a solid solution with the nickel and promotes the tin-nickel and phosphorous-nickel intermetallic compounds to precipitate. When the copper content is less than 2% by weight of the matrix, the variation in rate of stock removal is severe, and on the contrary, when the copper content exceeds 30% by weight, the rates of stock removal and life are poor.

The elements, tin and phosphorous, react with the solid solution of copper in nickel to form fine phase of the respective intermetallic compounds, promote uniform and moderate wear of bond and increase the hardness of bond. Powder of each element is added in such an amount as to form enough intermetallic compound to contribute to the grinding performance. For this purpose, the amounts of tin and of phosphorous to be added, which are considerably different in weight on account of the difference of specific gravity, are 1 to 40% and 0.2 to 3% by weight, respectively; thereby appropriate amounts of the intermetallic compounds precipitate. When the tin content is less than 1% by weight, the effect improving stock removal is unsatisfactory, and when it exceeds 40% by weight, the rates of stock removal and life are decreased and sintering of the matrix becomes difficult. Similarly, when the phosphorous content is less than 0.2% by weight, the variation in rate of stock removal is severe, and the effect improving stock removal is unsatisfactory, and when it exceeds 3% by weight, sintering of the matrix becomes difficult.

Thus, the preferred contents of the constituents in the matrix are summarized as follows: 3 to 20, particularly 5 to 15, % by weight of copper; 2 to 30, particularly 5 to 15, % by weight of tin; 0.2 to 2, particularly 0.5 to 1, % by weight of phosphorous; and 70% by weight or more of nickel, based on the total weight of the matrix.

While the use of zinc, antimony, selenium, or germanium in place of tin or the use of sulfur or magnesium in place of phosphorous also yields a similar intermetallic compound, tin and phosphorous are most favorable.

In the preparation of the sintered metal bonded diamond abrasive article of this invention, nickel, copper, tin, and phosphorous are all used in the form of powder passed through a mesh of #100. This, in cooperation with the formation of the intermetallic compounds from the constituent elements and with the partial replacement of nickel by copper, which has a relatively low melting point, enables the sintering to be carried out at temperatures as low as 600° to 950° C., whereby the graphitizing of diamond becomes evitable. Phosphorous, though it may be added singly, is preferably added as a copper-phosphorous alloy powder because easier handling, more uniform dispersion, and more stable sintering are possible. The diamond powder used in this invention is generally desirable to have grit sizes of 1 to 40$\mu$ and to be added in an amount of 0.1 to 10% by weight, but in certain applications the grain sizes and amount of the diamond are not limited to these ranges.

The sintered abrasive article of the invention is most suitably prepared by the conventional method of powder metallurgy in view of high volume production, i.e., it is prepared by mixing together the powders of all constituents for matrix and diamond powder and if necessary, with a small amount of a lubricant such as zinc stearate, pressing the mixture to shape, and then sintering the shaped compound in a non-oxidizing atmosphere. The hot press method or the induction furnace sintering method can also be applied to the preparation.

In the sintered composition thus obtained, the copper, tin, and phosphorous in the nickel base would affect one another to promote the sintering of matrix and at the same time would precipitate and uniformly disperse the intermetallic compound in the matrix. This would lead to the formation of the metal bond which is hard but wear uniformly at a moderate rate. By the self-dressing effect of this metal bond and owing to the pores formed in the metal bond, the effective retaining and renewal of the cutting points of diamond grits are achieved at the face of the abrasive article, thus providing a sintered metal bonded diamond abrasive article very easy to use practically, i.e., it exhibits increased rates of stock removal, particularly in fining or lapping operation, less variation in rate of stock removal, and less truing time, so functioning much effectively.

The invention will be illustrated in more detail by the following example, which is, however, not to be construed to limit the scope of the invention.

EXAMPLE

Mixtures of the respective compositions shown in Table 1 were prepared from nickel powder having an average grain size of 5μ and from the powders of other given elements which had been passed through a mesh of #250. After addition of 1 wt % diamond powder having a grit size of 8–16μ to each mixture, the mixtures were sintered at 800°–900° C., and different kinds of sintered metal bonded diamond abrasive articles called diamond pellet were obtained in the form of pellet of 16 mm in diameter and 3 mm in thickness, which were subjected to the grinding performance tests mentioned below. In the table, samples 1 and 2 are pellets according to this invention, samples 3 to 6 those of nickel-copper basis for reference, sample 7 those of nickel basis for reference, and sample 8 those of conventional copper-tin basis for reference.

Each sample was tested using a high-speed polishing machine provided with a pellet tool of 100 mm in diameter, to which 20 pellets of each sample were glued. Glass test pieces called BK-7 of 60 mm in diameter which were previously ground with an abrasive GC#500 or GC#280 to adjust their surface conditions were ground with the test abrasive articles each for 12 seconds while applying a load of 20 Kg. The rates of stock removal and the grinding ratios determined are shown in Table 1.

TABLE 1

| Sample No. | Composition of metal bond (Ni: the balance amount) | Rate of stock removal [GC#500] | Rate of stock removal [GC#280] | Grinding ratio (μ/μ) [GC#500] |
|---|---|---|---|---|
| 1 | Ni-10% Cu-10% Sn-0.8% P | 320 | 330 | 400 |
| 2 | Ni-5% Cu-17% Sn-0.4% P | 300 | 310 | 510 |
| 3 | Ni-5% Cu-2% P | 250 | 280 | 360 |
| 4 | Ni-10% Cu-0.5% P | 190 | 210 | 850 |
| 5 | Ni-8% Cu-15% Sn | 210 | 240 | 900 |
| 6 | Ni-8% Cu-5% Sn | 190 | 210 | 1100 |
| 7 | Ni-17% Sn | 180 | 210 | 1000 |
| 8 | Cu (the balance amount)-15% Sn-5% Ag | 170 | 180 | 250 |

As described hereinbefore, the sintered metal bonded diamond abrasive article according to the present invention is remarkably superior to the conventional abrasive articles of copper-tin basis in rate of stock removal and in grinding ratio and superior to the conventional abrasive articles of nickel-copper basis in rate of stock removal. It also exhibits less variation in rate of stock removal and is therefore very easy to use practically. The present abrasive article is expected to be used not only in fining of lenses but also over a wide range of applications, e.g., in grinding glasses, ceramics, and metallic semiconductors, etc.

We claim:

1. A metal bonded diamond abrasive article composed of a diamond powder and of a sintered nickel base metal bond retaining the diamond powder, which is characterized in that the sintered metal bond consists essentially of 2 to 30% by weight of copper, 1 to 40% by weight of tin, 0.2 to 3% by weight of phosphorous, and the balance of nickel, the total amount of copper, tin, and phosphorous being less than 50% by weight.

2. A metal bonded diamond abrasive article of claim 1, wherein the sintered metal bond consists essentially of 3 to 20% by weight of copper, 2 to 30% by weight of tin, 0.3 to 2% by weight of phosphorous, and the balance of 70% by weight or more of nickel.

* * * * *